US005745831A

United States Patent [19]

Nakazawa et al.

[11] Patent Number: 5,745,831

[45] Date of Patent: Apr. 28, 1998

[54] IMAGE FORMING APPARATUS HAVING AN INTERMEDIATE TRANSFER MEMBER AND METHOD OF FORMING OF IMAGE USING THE TRANSFER MEMBER

[75] Inventors: Akihiko Nakazawa, Shiroyama-machi; Hiroyuki Kobayashi, Fuji; Atsushi Tanaka; Tsunenori Ashibe, both of Yokohama; Takashi Kusaba, Kawasaki, all of Japan

[73] Assignee: Canon Kabushiki Kaisha, Tokyo, Japan

[21] Appl. No.: 566,176

[22] Filed: Dec. 1, 1995

[30] Foreign Application Priority Data

Dec. 6, 1994 [JP] Japan ..... 6-301856

[51] Int. Cl.[6] ..... G03G 15/16

[52] U.S. Cl. ..... 399/308; 399/302; 430/126

[58] Field of Search ..... 399/302, 308, 399/297; 430/126

[56] References Cited

U.S. PATENT DOCUMENTS

| | | | |
|---|---|---|---|
| 4,000,942 | 1/1977 | Ito et al. | 399/398 |
| 5,115,281 | 5/1992 | Ohtsuka et al. | 399/16 |
| 5,187,526 | 2/1993 | Zaretsky | 399/302 |
| 5,268,247 | 12/1993 | Hayashi | 399/308 X |
| 5,340,679 | 8/1994 | Badesha et al. | 430/126 |
| 5,438,398 | 8/1995 | Tanigawa et al. | 399/302 |
| 5,537,194 | 7/1996 | Henry et al. | 399/308 |
| 5,572,304 | 11/1996 | Seto et al. | 430/126 X |
| 5,623,330 | 4/1997 | Ishibashi | 430/126 X |

FOREIGN PATENT DOCUMENTS

| | | |
|---|---|---|
| 0453762 | 10/1991 | European Pat. Off. . |
| 63-301960 | 12/1988 | Japan . |
| 3-242667 | 10/1991 | Japan . |
| 4-81786 | 3/1992 | Japan . |
| 4-88385 | 3/1992 | Japan . |
| 5-333725 | 12/1993 | Japan . |

*Primary Examiner*—S. Lee

*Attorney, Agent, or Firm*—Fitzpatrick, Cella, Harper & Scinto

[57] ABSTRACT

An image forming apparatus has a first image supporting member and an intermediate transfer member having an outermost layer containing particles of conductive material. The ratio of (the maximum diameter/the minimum diameter) of the particle is 4 or more, and the maximum diameter is 1 to 80 μm. The above image forming apparatus has excellent durability and good image forming properties, and produces images without toner-filming.

16 Claims, 4 Drawing Sheets

IMAGE FORMING APPARATUS HAVING AN INTERMEDIATE TRANSFER MEMBER AND METHOD OF FORMING OF IMAGE USING THE TRANSFER MEMBER

BACKGROUND OF THE INVENTION

1. Field of the Invention

The present invention relates to an image forming apparatus, particularly to an image forming apparatus having an intermediate transfer member. It also relates to a method of forming an image using apparatus as aforesaid.

2. Description of the Prior Art

In the formation of a coloured image by an electrophotographic process, an intermediate transfer member can be used to build-up a coloured image by successively receiving imaged components in the individual colours (e.g. of a magenta image, a cyan image or a yellow image) corresponding to the colour information of the original image. The individual colour components of the image can be formed in succession in the same position on the intermediate transfer member, and it is easy to arrange that there is no shift in position between the successive images.

FIG. 1 is a schematic side view of a colour image forming apparatus for example, a copying machine or a laser beam printer. The apparatus in FIG. 1 has an intermediate transfer member 20 provided with an elastomeric surface. A cylindrical electrophotographic photosensitive member 1 (herein below referred to as "a photosensitive member") is used as a first image supporting member. The photosensitive member 1 is rotatable about an axis at a prescribed surface speed (herein below referred to as "a process speed"). The surface of the photosensitive member 1 is uniformly charged by means of a primary charger 2 (e.g. a corona charger) to impart an electric charge having a prescribed polarity and potential. The photosensitive member 1 is then subjected to imagewise exposure with light by an image exposure means (not shown) so that an electrostatic latent image corresponding to an image component of a first colour (e.g. a magenta image) is formed on the photosensitive member 1. Thereafter the electrostatic latent image is developed using a magenta toner by first development means 41 which contains a magenta coloured toner. During this operation, a second development means 42 which contains a cyan toner, a third development means 43 which contains a yellow toner and a fourth development means 44 which contains a black toner are inoperative. Therefore the first magenta toner image is not disturbed by the second to fourth development means 42 to 44.

The intermediate transfer member 20 may comprise a cylindrical support 21 and an elastomeric layer 22 formed on the support 21. The intermediate transfer member is rotated in the direction of the arrow shown in FIG. 1 at the same surface speed as the photosensitive member 1. The image component of the first colour (i.e. the magenta image) on the photosensitive member 1 is transferred to the peripheral surface of the intermediate transfer member 20 by an electric field formed by a first transfer bias potential which is applied between the intermediate transfer member 20 and the photosensitive member 1. The peripheral surface of the photosensitive member 1 is cleaned by means of a cleaning means 14 after the magenta image has been transferred to the intermediate transfer member 20. A cyan image, a yellow image and a black image are then transferred in succession and in super-imposed relationship onto the intermediate transfer member 20 in the same manner as the magenta image so that the desired colour image is built up. The first transfer bias which brings about transfer of each image component of each colour is supplied by a bias power supply 61. The polarity of the first transfer bias is different from the polarity of the charge which is applied to the toner. The voltage applied by the bias power supply 61 is preferably in the range +2 Kv to +5 Kv.

The colour image on the intermediate member 20 is then transferred to a receiving medium 24 which is the second image supporting member. The receiving medium 24 which may be paper sheets is conveyed from a feeder 9 to a nip which is defined between the intermediate transfer member 20 and a transfer roller 25, and a bias potential is applied to the roller 25 from a bias power supply 29. After transfer of the colour image to the receiving medium 24 has taken place, the receiving medium is conducted to a fixing station 15 at which the receiving medium is heated to fix the image. After transfer of the colour image has taken place, residual toner on the intermediate transfer member 20 is removed by means of a cleaning member 35.

Colour electrophotographic apparatus having the aforesaid intermediate transfer member is better than colour electrophotographic apparatus which does not have the intermediate transfer member e.g. the apparatus described in Japanese Laid Open Patent Application No 63-301960 in the following respects:

(a) Image components of the various colours can be transferred to the intermediate transfer member without the positions of each colour image component being shifted relative to that of the others.

(b) In the case of a colour electrophotographic apparatus which does not use an intermediate transfer member, the second image supporting member is fixed on the photosensitive member, so that the second image supporting member has to be relatively thin. On the other hand, colour electrophotographic apparatus using an intermediate transfer member does not require the second image supporting member to be fixed onto the photosensitive member, so that a variety of second image supporting members can be used. For example, both thin paper sheets (e.g. about 40 $g/m^2$) and thicker paper sheets (e.g. about 200 $g/m^2$) can be used as the second image supporting member. The second image supporting member can also be on a envelope, a postcard or a label.

However, when a electrophotographic apparatus using an intermediate transfer member is subjected to repeated use in bad environmental conditions, the following problems can arise:

(1) Transfer of the toner from the first image supporting member (e.g. a photosensitive member) to an intermediate member, and from the intermediate member to the second image supporting member (paper or overhead projector sheet) may take place with insufficient efficiency. As a result, a cleaning device has to be provided both for the photosensitive member and for the intermediate transfer member. Cleaning devices bring about wear of the photosensitive member and the intermediate transfer member, and tend to reduce the life of these members. Furthermore, a cleaning device has a relatively complex structure and can increase cost.

(2) As shown in FIG. 6, image transfer to the intermediate member or to the second image supporting member may take place incompletely (hereinbelow referred to as "a hollow image"). The hollow image can be caused by insufficient efficiency of the transfer as described in paragraph (1) above. The transfer efficiency can be affected by the surface characteristics or electrical resistance of the intermediate transfer member, by the bias voltage applied at the time of image transfer, and by the timing of the bias voltage. The main reasons for insufficient transfer efficiency have not been identified. However, it is known that the transfer efficiency is reduced under the following circumstances:

(a) where the apparatus has been subjected to prolonged use;

(b) where the apparatus is used in low temperature or high humidity environmental conditions.

(3) The intermediate transfer member can have a layer of rubber, resin or other elastomeric material. Japanese Laid Open Patent Application No 4-81786, 4-88385, 3-242667 and 5-333725 disclose preferred materials for use in such an elastomeric layer. However, there is no material which provides adequate performance over a full range of environmental conditions, including both conditions of low temperature and low humidity and conditions of high temperature and high humidity.

(4) There has been a trend towards printers or copying machines of small size. However, a large bias power supply is required in order to get a high transfer efficiency of the toner.

On the other hand an intermediate transfer member containing particles of conductive material has been proposed. Since such intermediate transfer member has a high conductivity, a small bias power supply can be used. However it was difficult to disperse conventional particles of conductive material uniformly. Furthermore a large quantity of conventional particles of conductive material must be dispersed to increase the conductivity of the intermediate transfer member. Therefore the intermediate transfer member containing the conventional particles has poor mechanical strength.

SUMMARY OF THE INVENTION

In one aspect the present invention provides an image forming apparatus comprising a first image supporting member and an intermediate transfer member having an outermost layer containing particles of conductive material;

characterised in that the ratio of (the maximum diameter/the minimum diameter) of the particle is 4 or more, and the maximum diameter is 1 to 80 μm.

The invention also provides an intermediate transfer member having an outermost layer containing particles of conductive material for an electrophotographic image forming apparatus;

characterised in that the ratio of (the maximum diameter/the minimum diameter) of the particle is 4 or more, and the maximum diameter is 1 to 80 μm.

The invention also relates to a method of forming an image using apparatus as aforesaid.

Embodiments of the above image forming apparatus can exhibit good durability and image forming properties under a wide range of environmental conditions, including low temperature, low humidity conditions and high temperature, high humidity conditions. The intermediate transfer member of the invention exhibits excellent transfer efficiency.

BRIEF DESCRIPTION OF THE DRAWINGS

How the invention may be put into effect will now be described, by way of example only, with reference to the accompanying drawings in which.

DETAILED DESCRIPTION OF THE INVENTION

Figure 1:
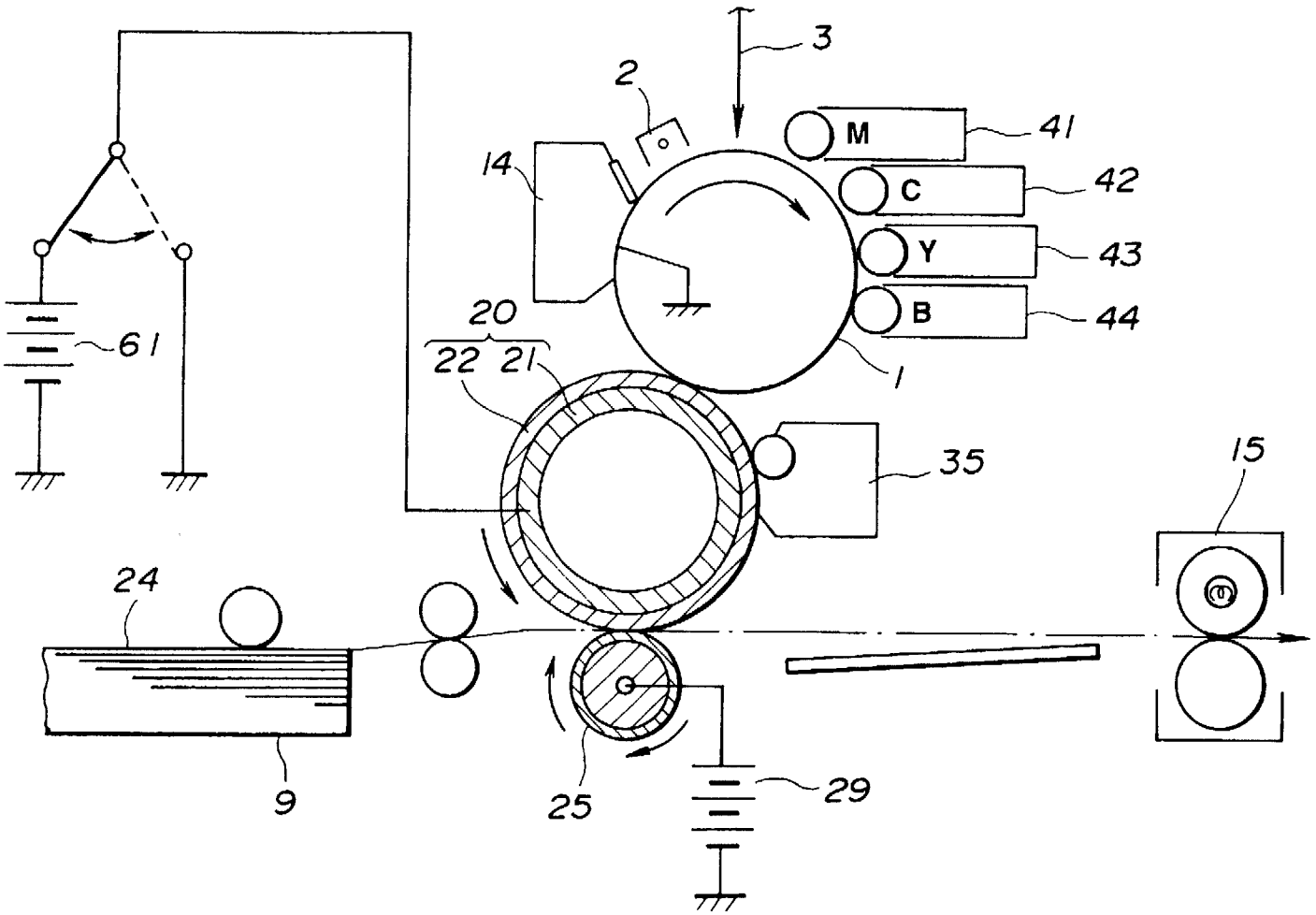
FIG. 1 is diagrammatic side view of one embodiment of an image forming apparatus.

In the following description "part(s)" and "%" means "weight part(s)" and "weight %" respectively.

The image forming apparatus of the present invention comprises a first image supporting member and an intermediate transfer member having an outermost layer containing particles of conductive material to which an image formed on the first image supporting member can be transferred. The apparatus is characterised in that the ratio (the maximum diameter/the minimum diameter) of the particles is 4 or more, and the maximum diameter is 1 to 80 μm. Hereinbelow, the ratio of the maximum diameter to the minimum diameter) of the particles is referred to as "the diameter ratio". Particles of conductive material used in the present invention have a good dispersibility, can give an appropriate conductivity to the intermediate member, and reinforce the outermost layer of the intermediate member. By using the aforesaid particles, the particle content in the outermost layer can be decreased. Furthermore, the number of particles which fall out from the outermost layer can be decreased. If the diameter ratio is less than 4 and the maximum diameter is less than 1 μm, transfer bias cannot be decreased. If the maximum diameter is more than 80 μm, it is difficult to disperse the particles uniformly.

The maximum diameter and the minimum diameter are measured in the following manner. First, an absolute maximum length and Feret's diameter of the particle of the conductive material are measured by means of an electron microscope and a LUZEX III image processing analyzer. This measurement is conducted on fifty particles which are randomly chosen. Then the maximum diameter and the minimum diameter are calculated by using the absolute maximum length and the Feret's diameter, that is to say, the maximum diameter is an arithmetic mean of the absolute maximum length, and the minimum diameter is an arithmetic mean of the Feret's diameter.

The particles used in the present invention preferably have a volume resistivity of $10^5$ Ω.cm or below, more preferably $10^{-2}$–$10^3$ Ω.cm. If the volume resistivity is more than $10^5$ Ω.cm, the intermediate transfer member has a poor conductivity. The volume resistivity of the particles of the conductive material can be measured by means of a LORESTA AP resistance measuring instrument (manufactured by Mitsubishi: Petrochemical Co., Ltd) or R8340 (manufactured by ADVANTEST). More specifically, a pellet sample of the conductive material is prepared by compressing a power under a pressure of 2,000 Kg/cm$^2$ and is measured by the aforesaid instrument. The outermost layer containing the particles of the conductive material preferably has an electrical resistance of $10^1$–$10^{13}$ Ω, more preferably $10^2$–$10^{10}$ Ω, furthermore $10^2$31 $5\times10^8$ Ω. If the electrical resistance is less than $10^1$ Ω, a sufficient transfer electric field cannot be obtained, and as a result the transfer efficiency decreases. If the electrical resistance is more than $10^{13}$ Ω, a large bias power supply is required. The electrical resistance of the outermost layer can be also identified by measuring a sample of the outermost layer by means of aforesaid resistance measuring instruments. The sample is prepared by forming the same layer as the outermost layer on an aluminium plate.

The content of the conductive material in the outermost layer is preferably 5–80%. If the content is less than 5%, the electrical resistance of the outermost layer may be insufficiently decreased. If the content is more than 80%, some particles of the conductive material may fall out from the outermost layer.

Example of the conductive material used in the present invention may be aluminium borate, strontium titanate, titanium oxide, aluminium oxide, magnesium oxide, silicon carbide, silicon nitride, mica surface-treated with tin oxide, antimony oxide or carbon black, aluminium, nickel and stainless steel. Particularly aluminium borate and titanium oxide may be preferable in the standpoint of dispersibility.

Particles of conductive material used in the present invention can be made by following methods. Particles of metal oxide can be made by a wet method, a solid phase baking method or a gas phase crystal growth method. Particles of carbon can be made by a gas phase crystal growth method. Particles of metal can be made by cutting metal which is drawn and stretched.

Figure 2:
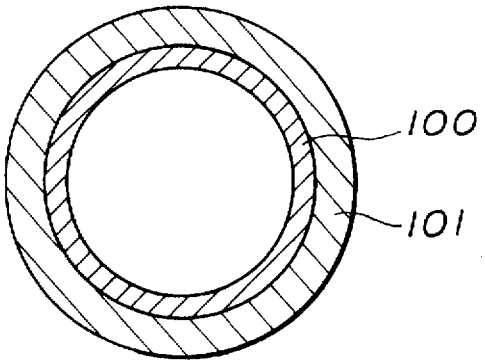
FIGS. 2, 3 and 4 and are views in cross-section of an intermediate transfer member intended for use in the apparatus for FIG. 1, the transfer members in these figures differing in their covering.
Figure 3:
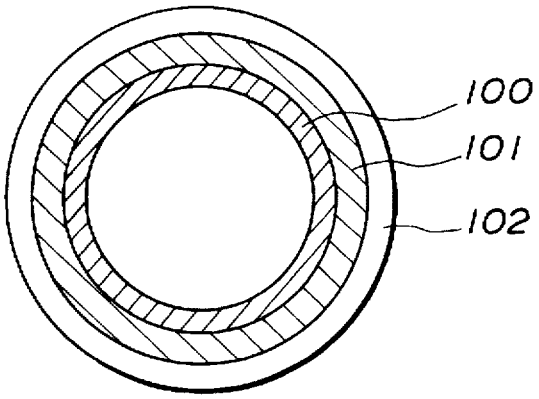
Figure 5:
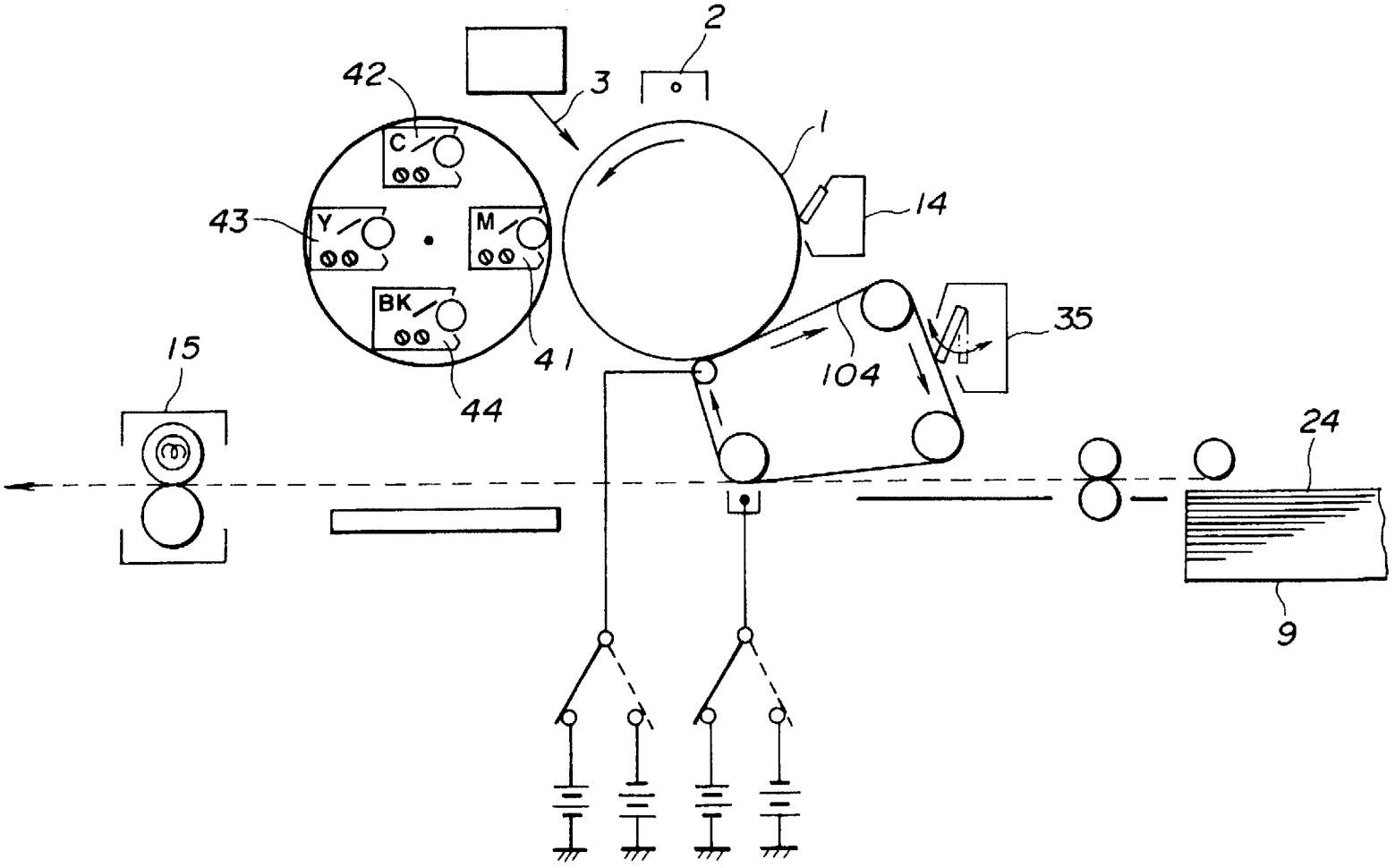
FIG. 5 is a diagrammatic side view of another embodiment of the image forming apparatus of the invention.
Figure 4:
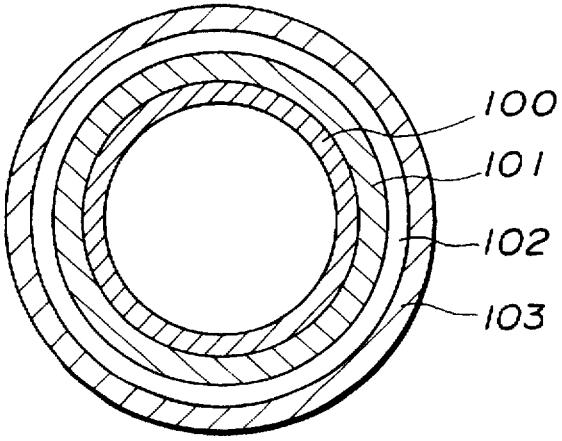
Figure 6:
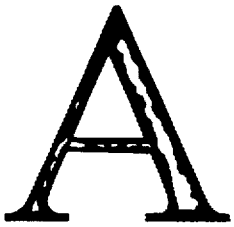
FIG. 6 an illustration showing the formation of a hollow image.

Various intermediate transfer members can be used, for example an endless belt shaped intermediate transfer member as shown in FIG. 5 and a transfer member which comprises a cylindrical support, and an elastic layer on the support and optionally one or more cover layers as shown in FIGS. 2–4. The electrical resistance and surface character of the intermediate transfer member can be adjusted when the cover layer is formed. A cylindrical intermediate transfer member is preferred from the standpoint of reduction in the shift in relative positions of the image components of the various colours, and from the standpoint of durability. The elastomeric layer is preferably of a rubber, another elastomeric material, or a resin. In FIGS. 2–5 100 represents the cylindrical support, 101 represents an elastomeric layer, 102 and 103 represent cover layers and 104 represents an intermediate transfer member in the form of an endless belt.

The cylindrical support 100 may be made of a conductive material which may be a metal or alloy, for example aluminium, aluminium alloys, iron, copper or stainless steel. It also may be made of a conductive resin containing with carbon powder or metallic powder. Examples of the rubber, elastomer or resin which may be used in the elastomeric layer and the cover layer of the intermediate transfer member include styrene-butadiene rubber, butadiene rubber, isoprene rubber, an ethylene-propylene copolymer, acrylonitrile-butadiene rubber, chloroprene rubber, butyl rubber, silicone rubber, fluorocarbon rubber, nitrile rubber, urethane rubber, acrylic rubber, epichlorohydrin rubber, norbonene rubber, a styrene type resin (i.e. a homopolymer or copolymer including styrene or a substitution product of styrene), for example polystyrene, chloropolystyrene, poly-α-methlystyrene, styrene-butadiene copolymer, styrene-vinyl chloride copolymer, styrene-vinyl acetate copolymer, styrene-maleic acid copolymer, styrene acrylic ester copolymer, styrene-methyl acrylate copolymer, styrene-ethyl acrylate copolymer, styrene-butyl acrylate copolymer, styrene-octyl acrylate copolymer and styrene-phenyl acrylate copolymer, styrene-methacrylate copolymer, styrene-methyl methacrylate copolymer, styrene-ethyl methacrylate copolymer, and styrene-phenyl methacrylate copolymer, styrene-alpha-chloromethyl acrylate copolymer, styrene-acrylonitrile-acrylic ester copolymer; vinyl chloride resin, resin-extended maleic acid resin, phenyl resin, epoxy resin, polyester resin, polyamide resin, polyethylene, polypropylene, ionomer resin, polyurethane resin, silicone resin, fluorocarbon resin, keton resin, ethylene-ethyl acrylate copolymer, xylene resin and polyvinyl butyryl. The above mentioned rubber, elastomer or resin material may be used singly or in combination of two or more of them.

The outermost layer advantageously contains a lubricious powder which may be an inorganic powder or an organic powder. Alternatively, it may contain a lubricant liquid such as silicone oil. The use of lubricant powder is preferred because lubricant powder does not damage the photosensitive member, and it has a good ability to adjust the lubricity of the intermediate transfer member. It produces good adhesion between each other lubricant powder, or a layer containing it, and another layer, since the layer also contains a binder resin.

The lubricity of the lubricant is measured as follows. A mixture of 20 parts lubricant, 100 part of a urethane prepolymer and five parts of curing agent is applied onto a polyethylene terephthalate (PET) plate by spray coating. The viscosity of the mixture can be adjusted by addition of toluene and methyl ethyl ketone. A comparative sample is prepared in the manner described above except that lubricant is not present. The sliding resistance of the sample containing lubricant and of the comparative sample are measured by means of a Heidon-14DR surface character measuring instrument manufactured by Shinto Kagaku Inc. In the measurement of sliding resistance of a plane pressure member of the surface character measuring instrument is covered with polyethylene terephthalate (PET), provides a load of 200 gf vertically towards the sample which is moved in a horizontal direction at a speed of 100 mn/min. A plane pressure member is described in ASTM D-1894. If the sliding resistance of the lubricant-containing sample is 80% or below of that of the comparative sample, the lubricant will exhibit desirable properties for the present purposes. Although the lubricant is not limited to the materials set out below, preferred examples are as follows:

Fluorocarbon rubber, fluorocarbon elastomers, fluorinated graphite, powders of organo-fluorine compounds such as polytetrafluoroethylene (PTFE), poly(vinylidenefluoride) (PVDF), ethylene-tetrafluoroethylene copolymer (ETFE), tetrafluoroethylene-perfluoro alkylvinyl ether copolymer (PFA), and powdered organosilicon compounds such as silicone resins, silicone rubbers and silicone elastomers, polyethylene (PE), polypropylene (PP), polystyrene (PS), acrylic resin, nylon resin, silica, alumina, titanium oxide and magnesium oxide. The above mentioned lubricants can be used individually or in combinations of two or more them.

The lubricant powder preferably has an average particle size of 0.02–50 μm from the standpoint of dispersibility of the lubricant and surface smoothness of the intermediate transfer member. If necessary, the surface of the lubricant particles can be treated with an agent which reduces damage to the lubricant. Furthermore, a dispersing agent can be used with the lubricant. The lubricant is preferably present in the outermost layer of the intermediate transfer member in an amount of 20–80% particularly 25–75%. If the content of lubricant is less than 20%, the intermediate transfer member may exhibit insufficient lubricity, and as a result toner-filming and decrease of the second transfer efficiency are liable to take place. If the content of lubricant is more than 80%, the intermediate transfer member may exhibit poor durability because of decrease of adhesion between each other lubricant or the outermost layer and another layer.

In order to form the outer most layer of the intermediate transfer member, conductive material, lubricant and resin, elastomer or rubber are mixed by means of well-known apparatus, for example a roll mill, a kneader, a Banbury mixer, a ball mill, a bead mill, an homogeniser, a paint shaker or a nanomizer. The thickness of the elastomeric layer is preferably 0.5 mm or above, more preferably 1 mm or above, and especially 1–10 mm. The thickness of the cover layer is preferably 3 mm or below more preferably 2 mm or below and especially 20 μm–1 mm. The relatively thin cover layer does not damage the softness of the elastomeric layer.

The electrical resistance of the intermediate transfer member is preferably $10^1$–$10^{13}\Omega$ especially $10^2$–$10^{10}\Omega$.

Particles of conductive material beyond the scope of the present invention may be present in the elastic layer or in the cover layer. Examples of such conductive materials include conductive resin and resin containing conductive particles. Examples of conductive resins include polymethyl methacrylate containing quaternary ammonium salts, polyvinyl aniline, polyvinyl pyrrole, polydiacetylene and polyethylene imine.

Examples of the resins which can be used in resin-containing conductive particles include urethanes, polyesters, vinyl acetate-vinylchloride copolymers and polymethylmethacrylate. In resins containing conductive particles, the conductive particles may be, for example, of carbon, aluminium or nickel.

The intermediate transfer member used in the present invention can be made as follows. A cylindrical metal support is first prepared, and rubber, elastomer or resin is formed into an elastic layer on the cylindrical support by melt moulding, injection moulding, dip coating or spray coating. Subsequently, a cover layer is formed on the elastomeric layer by a forming method described above if required.

A photosensitive member that is provided with a protective layer containing powdered fluorocarbon polymer on its photosensitive layer is preferably used as first image supporting member. An example of such a fluorocarbon polymer is polytetrafluoroethylene. Such a protective layer increases the efficiency of the first transfer member, and in particular its ability to transfer toner from the photosensitive member to the intermediate transfer member. As a result a high quality image can be formed which is relatively free from defects. Furthermore, the intermediate transfer member used in the present invention has good second transfer efficiency (i.e. the transfer efficiency from the intermediate transfer member to the second supporting member).

Examples of the second image supporting member used in the present invention include various kinds of paper and overhead projector (OHP) sheets.

The invention will now be described in more detailed with reference to the accompanying examples.

Example 1

An intermediate transfer member was made as follows. The rubber compound given below was applied onto a cylindrical aluminium support of external diameter 182 mm length 320 mm and aluminium thickness 5 mm by transfer moulding to provide a roller having an elastomeric layer.

| The Rubber Compound | |
|---|---|
| SBR | 100 parts |
| Conductive carbon black | 18 parts |
| Paraffin oil | 25 parts |
| Vulcanizing agent (sulfur) | 2 parts |
| Vulcanizing assistant agent | 2 parts |
| Vulcanizing promoter | 3 parts |

A coating liquid containing the following ingredients was prepared.

| | |
|---|---|
| Polyurethane Prepolymer (including solvent) | 100 parts |
| Curing agent (including solvent) | 50 parts |
| Conductive material (particles of conductive aluminium borate, maximum diameter 18 μm, minimum diameter 0.8 μm, the diameter ratio 22.5 the volume resistivity $2.0 \times 10^1$ Ω.cm) | 20 parts |
| Lubricant: PTFE powder (average particle size 0.3 μm) | 100 parts |
| Dispersing agent | 5 parts |
| Toluene | 80 parts |

The coating liquid was applied onto the elastomeric layer by spray coating to provide a cover layer, followed by heating for an hour at 90° C. to remove solvent from the cover layer and to bond the molecules of the cover layer. As a result, an intermediate transfer member having a strong cover layer was obtained. The content of the conductive aluminium borate in the cover layer was 11%. The total content of PTFE powder and the conductive aluminium borate was 67 weight % of the cover layer. The thickness of the cover layer was 80 μm. The electrical resistance of the intermediate transfer member was measured under environmental conditions of 23° C. and 65% RH. The outermost layer of the intermediate transfer member was held in contact with an aluminium plate (350 mm×200 mm). A voltage of 1 kV from a power supply was applied between the aluminium support of the intermediate transfer member and the aluminium plate. Then the potential difference between the ends of a 1 kΩ resistor was measured. The value of the electrical resistance of the intermediate transfer member was found from the voltage of the power supply, the potential difference across the 1 kΩ resistor and the resistance value of the 1 kΩ resistor.

The intermediate transfer member was assembled into an electrophotographic copying machine as shown in FIG. 1. The machine was used to form colour images successively on 10,000 sheets (durability test) in this durability test, the transfer efficiency of a cyan image, the image quality and the toner filming were evaluated. After that, the durability test was continued until 20,000 sheets had been copied. The durability test was carried out under the following conditions. The first image supporting member was an OPC photosensitive member comprising a conductive support, an under-coat layer a charge generating layer and a charge transport layer and a protective layer containing PTFE particles disposed in this order on the support. The surface potential was −750 V, the toner for all the colours used was a non-magnetic single component toner, the first transfer bias was +500 V, the second transfer bias was +3000 V, the process speed was 120 mm/sec, the developing bias was −550 V and the second image supporting member had a weight of 80 g/m$^2$. Both biases were low in comparison with conventional biases. The first transfer efficiency and the second transfer efficiency were calculated using the following equations in which image density is measured using a Macbeth reflection densitometer RD-918 manufactured by Macbeth Inc.

The first transfer efficiency={A/(B+A)}×100 (%)

The second transfer efficiency={C/(D+C)}×100 (%)

A: Density of a image on the intermediate transfer member.

B: Density of residual toner on the photosensitive member after an image has been transferred to the intermediate transfer member.

C: Density of an image on the second image supporting member.

D: Density of residual toner on the intermediate transfer member after an image has been transferred to the second image supporting member.

The densities were measured in the following manner. Images on the photosensitive member and on the intermediate transfer member were covered with adhesive tape. Then each adhesive tape was peeled off so that the respective image was transferred to the adhesive tape. The adhesive tape carrying the image was adhered to a piece of white paper to make a first sample. A second or reference sample was made which comprised a piece of white paper and adhesive tape adhered to it but not carrying an image. The densities A, B and D were ascertained by measuring the density of the first and second samples. The intermediate transfer member was held in contact with an OPC photosensitive member which had no protective layer with contacting pressure of 1 kg at a temperature of 45° C. and 95% RH for two weeks (contact test). After two weeks, the surface of the intermediate transfer member was visually evaluated. The results are shown in table 1. After the durability test of 20,000 sheets, the image quality and toner filming were evaluated visually. The toner filming is the toner filming on the intermediate transfer member. The results are shown in table 1. In table 1, ⊙ means very good and ○ means good.

Example 2

An intermediate transfer member was prepared in the same way as example 1 except that conductive aluminium borate 20 parts used in example 1 was changed to particles of conductive titanium oxide (maximum diameter 15 μm, minimum diameter 0.7 μm, diameter ratio 21.4, volume resistivity $3.5\times10^{1}$ Ω.cm) 20 parts. The resulting intermediate transfer member was assembled into a colour electrophotographic copying machine as shown in FIG. 1, and the colour electrophotographic copying machine was evaluated in the same way as example 1. The results are shown in table 1.

Example 3

An intermediate transfer member was prepared in the same way as in example 1 except that the conductive aluminium borate 20 parts used in example 1 was changed to particles of conductive mica (maximum diameter 25 μm, minimum diameter 0.5 μm, diameter ratio 50.0, volume resistivity $1.5\times10^{1}$ Ω.cm) 20 parts. The resulting intermediate transfer member was assembled into a colour electrophotographic copying machine as shown in FIG. 1, and the colour electrophotographic copying machine was evaluated in the same way as example 1. The results are shown in table 1.

Example 4

The intermediate transfer member of the invention was prepared in the same way as in example 1 except that the cover layer used in example 1 was changed to another cover layer. Coating liquid for the cover layer used in example 4 was containing following ingredients.

Liquid containing fluorine compound 100 parts

| | |
|---|---|
| Particles of conductive aluminium borate (the same particles as example 1) | 10 parts |
| Toluene | 30 parts |

The coating liquid was applied onto the elastic layer by dip coating to provide a cover layer, followed by heating for two hours at 120° C. to remove solvent from the cover layer. The content of the conductive aluminium borate in the cover layer was 30%. The resulting intermediate transfer member was assembled into a colour electrophotographic copying machine as shown in FIG. 1 which was evaluated in the same way as in example 1 to give the results shown in table 1.

Example 5

An intermediate transfer member was prepared in the same manner as in example 1 except that the content of the conductive aluminium borate used in example 1 was changed to 10 parts. The content of the conductive aluminium borate is 6%. The resulting the intermediate member was assembled into a colour electrophotographic copying machine as shown in FIG. 1, and the colour electrophotographic copying machine was evaluated in the same manner as example 1.

Example 6

The coating liquid for the cover layer prepared in example 1 was coated onto an outer surface of an endless belt which was made of a mixture comprising 100 parts of PVDF and 3 parts of high conductivity carbon black, and hardened in the same manner as example 1 to provide an endless belt-shaped intermediate transfer member. This intermediate transfer member was assembled into a colour electrophotographic copying machine as shown in FIG. 5 and the machine was evaluated in the same manner as example 1. The results are shown in table 1. An electrical resistance of the endless belt-shaped intermediate transfer member was measured in the following manner. First, an aluminium rod was put on the inner surface of the intermediate transfer member. The aluminium rod was 1 kg in weight, and the same length as the width of the intermediate transfer member. Then the outermost layer of the intermediate transfer member was held in contact with an aluminium plate (350 mm×200 mm). A voltage of 1 kV from a power supply was applied between the aluminium rod and the aluminium plate. Then the potential difference between the ends of a 1 kΩ resistor was measured. The value of the electrical resistance of the intermediate transfer member was found from the voltage of the power supply, the potential difference across the 1 kΩ resistor and the resistance value of the 1 kΩ resistor.

Example 7

An intermediate transfer member was prepared in the same way as in example 1 except that the content of the particles of conductive aluminium borate used in example 1 was changed to 5 parts. The content of the conductive aluminium borate was 3.1%. The total content of the PTFE powder and the conductive aluminium borate was 66%. The resulting intermediate transfer member was assembled into a colour electrophotographic copying machine as shown in FIG. 1, which was evaluated as in example 1 to give the results shown in table 1. In example 7, the second transfer bias was +5500 V.

Comparative Example 1

An intermediate transfer member was prepared in the same manner as in example 1 except that the particles of conductive aluminium borate, PTFE powder and dispersing agent were not used. The thus prepared intermediate transfer member was assembled in a colour electrophotographic copying machine as in FIG. 1, and the machine was evaluated as shown in example 1. The intermediate transfer member exhibited poor efficiency and high second transfer bias even at a short stage. Therefore the durability test was not continued.

Comparative Example 2

An intermediate transfer member was prepared in the same way as in example 1 except that the cover layer used in example 1 was changed to another cover layer. Coating liquid for the cover layer used in comparative example 2 contained following ingredients.

| | |
|---|---|
| Polyurethane Prepolymer (including solvent) | 100 parts |
| Curing agent (including solvent) | 50 parts |
| Conductive material (particles of conductive titanium oxide, maximum diameter 0.35 μm, minimum diameter 0.32 μm, diameter ratio 1.1, volume resistivity $3.5 \times 10^1$ Ω.cm) | 100 parts |
| Toluene | 40 parts |

The coating liquid was applied onto the elastic layer in the same manner as in example 1. The content of the conductive titanium oxide was 67%. The resulting intermediate transfer member was assembled into a colour electrophotographic copying machine as shown in example 1, and the colour electrophotographic copying machine which was evaluated in the same way as example 1. As the results show, uneven partial images were formed after a short period. Therefore the durability test was not continued. The reason why the uneven images were formed seemed to be poor dispersibility of the particles of conductive titanium oxide.

TABLE 1

| | RESISTANCE (Ω) | FIRST TRANSFER BIAS (V) | SECOND TRANSFER BIAS (V) | FIRST TRANSFER EFFICIENCY (%) INITIAL | FIRST TRANSFER EFFICIENCY (%) AFTER DURABILITY | SECOND TRANSFER EFFICIENCY (%) INITIAL | SECOND TRANSFER EFFICIENCY (%) AFTER DURABILITY | CONTACT TEST | IMAGE QUALITY | FILMING |
|---|---|---|---|---|---|---|---|---|---|---|
| EXAMPLE 1 | $6.5 \times 10^6$ | 350 | 3200 | 97 | 93 | 95 | 92 | ◎ | ◎ | ◎ |
| EXAMPLE 2 | $9.5 \times 10^6$ | 410 | 3300 | 96 | 93 | 94 | 92 | ◎ | ◎ | ◎ |
| EXAMPLE 3 | $8.6 \times 10^6$ | 400 | 3300 | 96 | 92 | 93 | 91 | ◎ | ○ | ◎ |
| EXAMPLE 4 | $1.2 \times 10^6$ | 300 | 3000 | 97 | 94 | 91 | 88 | ◎ | ○ | ○ |
| EXAMPLE 5 | $3.0 \times 10^7$ | 450 | 4000 | 93 | 91 | 92 | 90 | ◎ | ◎ | ○ |
| EXAMPLE 6 | $1.2 \times 10^6$ | 300 | 3000 | 97 | 94 | 92 | 90 | ◎ | ○ | ◎ |
| COMP. EXAMPLE 1 | $5.8 \times 10^9$ | 1800 | 8000 | 85 | — | 80 | — | ◎ | — | — |
| EXAMPLE 7 | $1.2 \times 10^6$ | 700 | 5500 | 89 | 86 | 92 | 89 | ◎ | ○ | ○ |
| COMP. EXAMPLE 2 | $8.9 \times 10^6$ | 400 | 3200 | 87 | — | 82 | — | ◎ | — | — |

We claim:

1. An image forming apparatus comprising:

a first image supporting member; and an intermediate transfer member comprising an outermost layer containing particles of conductive material, wherein a ratio of a maximum diameter to a minimum diameter of the particles is 4 or more, and the maximum diameter is 1 to 80 μm.

2. An image forming apparatus according to claim 1, wherein a volume resistivity of the conductive material is $10^5$ Ω.cm or below.

3. An image forming apparatus according to claim 2, wherein the volume resistivity of the conductive material is $10^{-2}$ to $10^3$ Ω.cm.

4. An image forming apparatus according to claim 1, wherein a content of the conductive material in the outermost layer is 5 to 80%.

5. An image forming apparatus according claim 1, wherein a lubricious material is contained in the outermost layer.

6. An image forming apparatus according to claim 5, wherein a content of the lubricious material in the outermost layer is 20% or more.

7. An image forming apparatus according to claim 5 or 6, wherein a total content of the conductive material and the lubricious material in the outermost layer is 80% or below.

8. An image forming apparatus according to claim 1, wherein an electrical resistance of the intermediate transfer member is $10^1$ Ω to $10^{13}$ Ω.

9. An image forming apparatus according to claim 8, wherein the electrical resistance of the intermediate transfer member is $10^2$ to $10^{10}$ Ω.

10. An image forming apparatus according to claim 1, wherein the intermediate transfer member is cylindrical.

11. An image forming apparatus according to claim 1, wherein the first image supporting member comprises an electrophotographic photosensitive member.

12. An image forming apparatus according to claim 11, wherein an outermost layer of the electrophotographic photosensitive member contains particles of fluorocarbon resin.

13. An image forming apparatus according to claim 1, wherein the apparatus comprises a multi-color image forming apparatus.

14. An intermediate transfer member for an electrophotographic image forming apparatus, comprising:

an outermost layer containing particles of conductive material, wherein a ratio of a maximum diameter to a minimum diameter of the particles is 4 or more, and the maximum diameter is 1 to 80 μm.

15. A method for forming an image comprising the steps of:

providing an image supporting member and an intermediate transfer member, the intermediate transfer member comprising an outermost layer containing particles of conductive material, wherein a ratio of a maximum diameter to a minimum diameter of the particles is 4 or more, and the maximum diameter is 1 to 80 μm; and applying toner imagewise to an image-receiving member using the image supporting member and the intermediate transfer member.

16. A method for forming an image comprising the steps of:

providing a first image supporting member and an intermediate transfer member, an outermost layer of the intermediate transfer member containing particles of conductive material, wherein a ratio of a maximum diameter to a minimum diameter of the particles is 4 or more, and the maximum diameter is 1 to 80 μm;

transferring a toner image from the first image supporting member to the intermediate transfer member; and transferring the toner image from the intermediate transfer member to a second image supporting member.

* * * * *

UNITED STATES PATENT AND TRADEMARK OFFICE

CERTIFICATE OF CORRECTION

PATENT NO. : 5,745,831
DATED : April 28, 1998
INVENTOR(S) : Akihiko NAKAZAWA, et al.

It is certified that error appears in the above-identified patent and that said Letters Patent is hereby corrected as shown below:

Column 4, line 7, after "6", insert --is--;
Line 22, delete "of the" and insert therefor --(the--;
Line 62, delete "$10^2 31\ 5\times10^8$" and insert therefor --$10^2$-$5\times10^8$--.

Column 5, line 45, delete "with".

Column 6, line 48, after "more", insert --of--.

Column 7, line 52, delete "detailed" and insert therefor --detail--.

Column 9, line 3, delete "a" and insert therefor --an--;
Line 67, after "containing", insert --the--.

Column 11, line 15, after "contained", insert --the--.

Column 12, line 6, after "according", insert --to--.

Signed and Sealed this

Thirteenth Day of October 1998

*Attest:*

*Attesting Officer*

Bruce Lehman

BRUCE LEHMAN

*Commissioner of Patents and Trademarks*